US011530584B2

(12) United States Patent
Fanini et al.

(10) Patent No.: US 11,530,584 B2
(45) Date of Patent: Dec. 20, 2022

(54) DOWNHOLE ROBOTIC SHUTTLE FOR PERFORMING PROGRAMED OPERATIONS

(71) Applicants: Otto Fanini, Houston, TX (US); Daniel Cousin, Humble, TX (US)

(72) Inventors: Otto Fanini, Houston, TX (US); Daniel Cousin, Humble, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 34 days.

(21) Appl. No.: 17/133,846

(22) Filed: Dec. 24, 2020

(65) Prior Publication Data

US 2022/0205328 A1 Jun. 30, 2022

(51) Int. Cl.

| | |
|---|---|
| ***E21B 23/00*** | (2006.01) |
| ***E21B 34/06*** | (2006.01) |
| ***E21B 17/02*** | (2006.01) |

(52) U.S. Cl.

CPC ..... *E21B 23/001* (2020.05); *E21B 17/028* (2013.01); *E21B 34/06* (2013.01); *E21B 2200/06* (2020.05)

(58) Field of Classification Search

CPC ..... E21B 23/001; E21B 17/028; E21B 34/06; E21B 2200/06

See application file for complete search history.

(56) References Cited

U.S. PATENT DOCUMENTS

| | | | | |
|---|---|---|---|---|
| 6,378,627 | B1 | 4/2002 | Tubel et al. | |
| 6,450,104 | B1 * | 9/2002 | Grant | B08B 9/049 104/138.1 |
| 6,454,011 | B1 * | 9/2002 | Schempf | E21B 19/143 166/70 |
| 2004/0055746 | A1 | 3/2004 | Ross et al. | |

(Continued)

FOREIGN PATENT DOCUMENTS

KR 20130059932 A 6/2013

OTHER PUBLICATIONS

Baker Hughes; "InForce Surface Control System"; 2013 Baker Hughes Incorporated; Retrieved Online URL://https.www.bakerhughes.com; 2 pages.

(Continued)

*Primary Examiner* — Brad Harcourt

(74) *Attorney, Agent, or Firm* — Cantor Colburn LLP

(57) ABSTRACT

A downhole robotic shuttle includes multiple modules coupled together in series to be conveyed through a cased geologic borehole. One or more of the modules includes: a coupling mechanism to couple one module to an adjacent module, a movement mechanism to enable conveyance of the module having the movement mechanism through the cased borehole; a steering mechanism to steer the module comprising the steering mechanism to achieve a selected orientation within the cased borehole; a motor configured to power the movement mechanism and/or the steering mechanism; an actuator to perform a selected action; a sensor to sense a selected parameter; a memory to receive instructions (Continued)

for performing at least one of the selected action and another action; and a controller to control at least one of the motor, steering mechanism, robotic arm, or sensor in accordance with the instructions received from the memory and sensed data received from the sensor.

20 Claims, 4 Drawing Sheets

(56) References Cited

U.S. PATENT DOCUMENTS

| | | | | |
|---|---|---|---|---|
| 2008/0128128 | A1* | 6/2008 | Vail | E21B 4/18 166/241.1 |
| 2008/0308318 | A1* | 12/2008 | Moore | E21B 4/04 175/51 |
| 2010/0147047 | A1 | 6/2010 | Kerdiles et al. | |
| 2016/0130912 | A1* | 5/2016 | Holder | E21B 43/14 175/4.51 |
| 2019/0032481 | A1* | 1/2019 | Lerner | G06K 19/06009 |
| 2020/0131883 | A1 | 4/2020 | Arsalan et al. | |
| 2020/0392803 | A1* | 12/2020 | Zhao | E21B 47/00 |
| 2021/0189820 | A1* | 6/2021 | Baklanov | E21B 23/14 |

OTHER PUBLICATIONS

Correa, et al.; "Intelligent Completion or Well Intervention Robot?"; 2017; Society of Petroleum Engineers; 12 pages.

International Search Report and Written Opinion; PCT/US2021/062392; Korean Intellectual Property Office; dated Apr. 1, 2022; 10 pages.

Moritis, Guntis; "Smart, Intelligent Wells Provide Real-Time Well Control, Monitoring"; Oil & Gas Journal; Apr. 2, 2001, vol. 99.14; 7 pages.

* cited by examiner

DOWNHOLE ROBOTIC SHUTTLE FOR PERFORMING PROGRAMED OPERATIONS

BACKGROUND

Boreholes are typically drilled into earth formations having reservoirs of hydrocarbons in order to extract the hydrocarbons. Once the boreholes are drilled, a variety of completion operations must be performed in the boreholes before the hydrocarbons can be extracted. Hence, innovations that improve the efficiency and efficacy of performing the completion operations would be well received in the hydrocarbon production industry.

SUMMARY

Disclosed is a downhole robotic shuttle. The downhole robotic shuttle includes a plurality of modules configured to be coupled together in series wherein the series of modules is configured to be conveyed through a cased borehole penetrating a geologic formation. One or more of the modules in the plurality of modules includes: a coupling mechanism configured to couple one module to an adjacent module; a movement mechanism configured to enable conveyance of the module comprising the movement mechanism through the cased borehole; a steering mechanism configured to steer the module comprising the steering mechanism to achieve a selected orientation within the cased borehole; a motor configured to power the movement mechanism and/or the steering mechanism; an actuator configured to perform a selected action; a sensor configured to sense a selected parameter; a memory configured to receive instructions for performing at least one of the selected action and another action; and a controller coupled to and configured to control at least one of the motor, steering mechanism, actuator, or sensor in accordance with the instructions received from the memory and sensed data received from the sensor.

Also disclosed is a method for performing an operation in a cased geologic borehole penetrating a geologic formation. The method includes: downloading instructions into a memory of a robotic shuttle, the robotic shuttle comprising a plurality of modules coupled together in series, one or more of the modules comprising a coupling mechanism configured to couple one module to an adjacent module, a movement mechanism configured to enable conveyance of the module comprising the movement mechanism through the cased borehole, a steering mechanism configured to steer the module comprising the steering mechanism, and a motor configured to power the movement mechanism and/or the steering mechanism; conveying the robotic shuttle to a selected orientation at a selected location in the cased borehole in accordance with the instructions using a controller disposed on the robotic shuttle; sensing a selected parameter using a sensor disposed on the robotic shuttle; and performing the operation with an actuator disposed on the robotic shuffle and controlled by the controller in accordance with the instructions received from the memory and sensed data received from the sensor.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Disclosed are apparatuses and methods for performing an operation in a borehole penetrating the earth. The apparatuses and methods involve a robotic shuffle that is configured to traverse the borehole, which in general is cased. The robotic shuffle includes a plurality of modules coupled in series. Each of the modules are configured to perform different or overlapping functions. At least one of the modules includes a processing system configured to receive downloaded instructions for performing one or more functions or operations. For example, the downloaded instructions can tell the robotic shuttle a location to go to in the borehole, an orientation to achieve at the location, and an operation to be performed at the location generally using sensors and an actuator such as a robotic arm. A payload and specialized tools may also be conveyed by the robotic shuttle to perform the operation.

Figure 1:
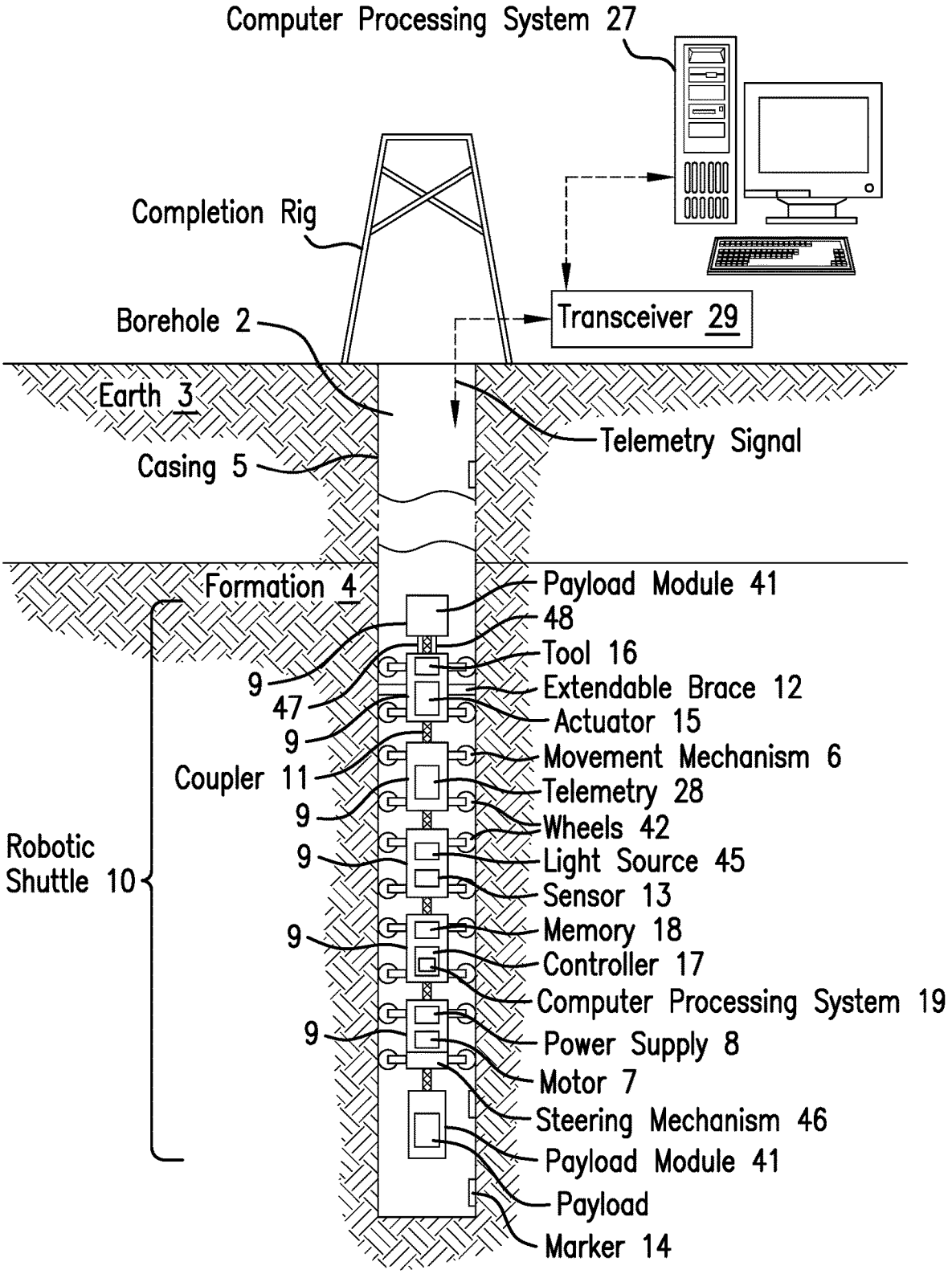
FIG. 1 illustrates a cross-sectional view of a robotic shuttle disposed in a borehole penetrating the earth.

FIG. 1 illustrates a cross-sectional view of a robotic shuttle 10 disposed in a borehole 2 penetrating the earth 3, which has an earth formation 4. The borehole 2 is lined with a casing 5. The robotic shuttle 10 includes a plurality of shuttle modules 9 coupled together in a series arrangement. Each of the shuttle modules 9 includes a coupling mechanism or coupler 11 configured to couple one shuttle module 9 to an adjacent shuttle module 9 in series. In one or more embodiments, the coupler 11 is a flat bar having a hole in it that aligns with a hole in a bar connected to the adjacent shuttle module 9. The flat bars can be secured to one another using a pin or bolt disposed in the aligned holes. Alternatively, a remote-controlled lock and latch mechanism (not shown) may be used to couple modules 9 together. Each coupler 11 may include a power bus 48 for providing electrical power to an adjacent module 9 and/or a communication bus 49 for providing communications to an adjacent module 9. One or more or the shuttle modules 9 includes a movement mechanism 6. Non-limiting embodiments of the movement mechanism 6 include wheels and "caterpillar-type" tracks. In one or more embodiments, the movement mechanism 6 includes a spring type device (not shown) configured to urge the movement mechanism 6 to maintain contact with the cased borehole wall. For example, wheels can be urged outward to maintain contact with the cased borehole wall. One or more of the shuttle modules 9, such as a payload module 41, may not have the movement mechanism 6, but may be suspended from an adjacent shuttle module 9. One or more of the shuttle modules 9 include a motor 7 configured to power the movement mechanism 6. Non-limiting embodiments of the motor 7 include an electric motor and a hydraulic motor. One or more of the shuttle modules 9 includes a power supply 8 for powering the motor 7 or other modules 9. Non-limiting embodiments of the power supply 8 include a battery and a fuel cell. One or more of the shuttle modules 9 includes a steering mechanism 46 configured to steer the movement mechanism 6 to which the steering mechanism 46 is coupled.

One or more of the shuttle modules 9 includes an extendable brace 12 configured to extend to engage a wall of the borehole 2 in order to anchor the shuttle module 9 having the brace 12 in place. In one or more embodiments, the extendable brace is actuated by a rotating screw. In one or more embodiments, the extendable brace 12 may include a lock and latch mechanism (not shown) to remotely lock the brace 12 in place and a lock and latch actuator (not shown) to remotely lock or unlock the lock and latch mechanism to actuate or release the brace 12, respectively.

One or more of the shuttle modules 9 include a sensor 13. Non-limiting embodiments of the sensor 13 include an imaging sensor (e.g., a still or video camera), an acoustic sensor, a radiation detector (e.g., gamma-ray detector) a radio-frequency identification (RFID) tag reader, chemical detector, magnetometer, gravimeter, and orientation sensor. The magnetometer, gravimeter, and/or orientation sensor may among other things provide sensed data used for navigation purposes. In one or more embodiments, the casing 5 includes identification markers 14 at known locations that can be read by the sensor 13. Hence, the shuttle module 9 having the sensor 13 can determine a location in the borehole 2 based on reading one of the markers 14. In one or more embodiments, the markers 14 are bar codes or RFID tags. In one or more embodiments, the sensor 13 may include a radiation emitter (e.g., chemical or electronic) for emitting radiation (e.g., gamma-rays or neutrons) used to perform property measurements such as material density.

One or more of the shuttle modules 9 may include a light source 45. The light source 45 is configured to illuminate an interior of the borehole 2 such as for imaging purposes.

One or more of the shuttle modules 9 include an actuator 15 configured to perform mechanical operations in the borehole 2. Non-limiting embodiments of the mechanical operation include operating a valve or damper such as by turning a valve stem or moving a lever. One or more mechanical operations may include using a tool 16 such as a welding or cutting device (e.g., a plasma cutter) in non-limiting embodiments.

One or more of the shuttle modules 9 include a controller 17. The controller 17 is configured to control operation of the plurality of shuttle modules 9. Instructions for the operation of the plurality of shuttle modules 9 may be downloaded into memory 18. The instructions can be accessed by the controller 17 so that the controller 17 can control the operation of the plurality of shuttle modules 9 in accordance with a program of operational steps. The program of operational steps may include moving the plurality of shuttle modules 9 to a selected location identified by the sensor 13, extending the brace 12 to lock the shuttle module or modules 9 in place, and performing an operation using the actuator 15 and tool 16 in a non-limiting embodiment. In one or more embodiments, the controller 17 may include a computer processing system 19 to execute an algorithm stored in the memory 18. In one or more embodiments, the controller 17 may be configured as a navigation module. The navigation module can be configured to store a map in the memory 18 and provide navigation instructions based on the map and or sensed data using the computer processing system 19. Navigation modules may be disposed on one or more shuttle modules 9 as necessary for long-range (e.g., from surface to particular location) and/or short-range (e.g., within a few meters of the particular location) navigation and positioning using the steering mechanism 46 for example.

One or more of the shuttle modules 9 may include telemetry 28 configured for communicating with a transceiver 29 at the surface of the earth 3. Non-limiting embodiments of the telemetry 28 included acoustic telemetry and electromagnetic wave telemetry. Data obtained downhole such as by the sensor 13 may be transmitted to the transceiver 29, which in turn may transmit the data to a surface computer processing system 27 for further processing. Commands from the transceiver 29 and/or the surface computer processing system 27 may also be transmitted to one or more of the shuttle modules 9. Instructions may also be transmitted to the memory 18 using the telemetry 28.

Figure 2:
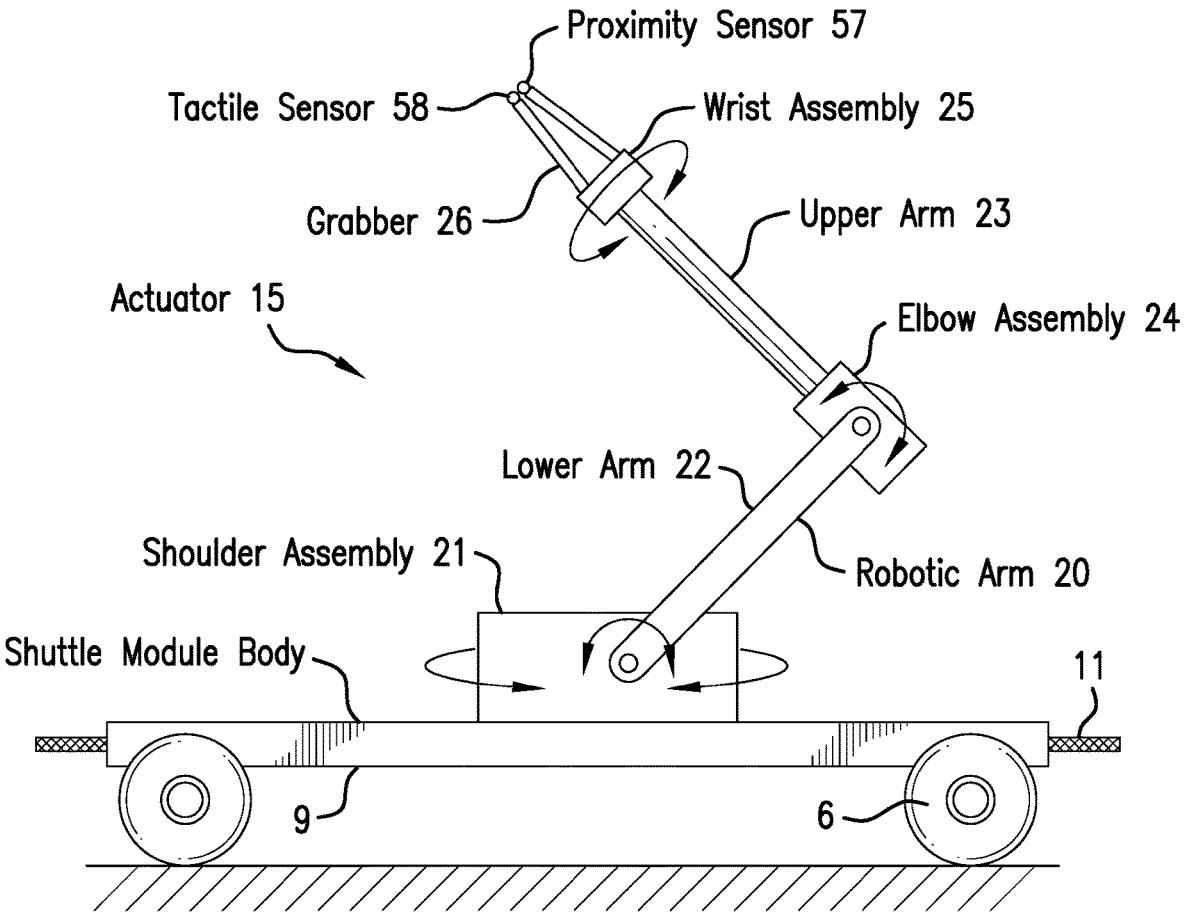
FIG. 2 depicts aspects of a robotic arm in the robotic shuttle.

FIG. 2 depicts aspects of one embodiment of the actuator 15. In the embodiment of FIG. 2, the actuator 15 includes a robotic arm 20. The robotic arm 20 includes a shoulder assembly 21 configured to rotate 360° about an axis perpendicular to a body of the shuttle module 9. The robotic arm 20 includes a lower arm 22 connected to the shoulder assembly 21 at one end of the lower arm 22 where that end can rotate about an axis in a plane parallel to the body of the shuttle module 9. Another end of the lower arm 22 is connected to an elbow assembly 24. The elbow assembly 24 connects the lower arm 22 to an upper arm 23 and allows the upper arm 23 to articulate with respect to the lower arm 22. At an opposing end of the upper arm 23 is a grabber 26 having mechanical fingers configured to grab or grip a selected object. The grabber 26 is connected to the upper arm 23 by a wrist assembly 25 that allows the grabber 26 to rotate 360° about an axis parallel to the upper arm 23 and to rotate about an axis perpendicular to the upper arm 23. Each of the shoulder assembly 21, the elbow assembly 24, and the wrist assembly 25 include local actuators configured to move or rotate components connect the corresponding assembly. Non-limiting embodiments of the local actuators include an electric motor, an electrically operated piston, and a hydraulically operated piston. The robotic arm 20 is configured to be folded into a travel position for conveyance through the borehole 2. It can be appreciated that the robotic arm 20 can have other configurations as needed for specialized applications, such as more or fewer arms or a grabber configured for a specific operation. In one or more embodiments, the robotic shuttle 10 can have multiple robotic arms 20 with each robotic arm 20 configured for a specialized task. In one or more embodiments, the sensor 13 and/or light source 45 can be attached to the robotic arm 20 for getting the sensor 13 closer to a selected area of interest for sensing purposes. In one or more embodiments, a proximity sensor 57 and/or a tactile sensor 58. In one or more embodiments, the shuttle module 9 carrying the actuator 15 may include a motor and transmission (not shown) coupled to the wheels, which may be configured for three-dimensional steering, for positioning the actuator 15 in a desired location and for orientation.

Figure 3:
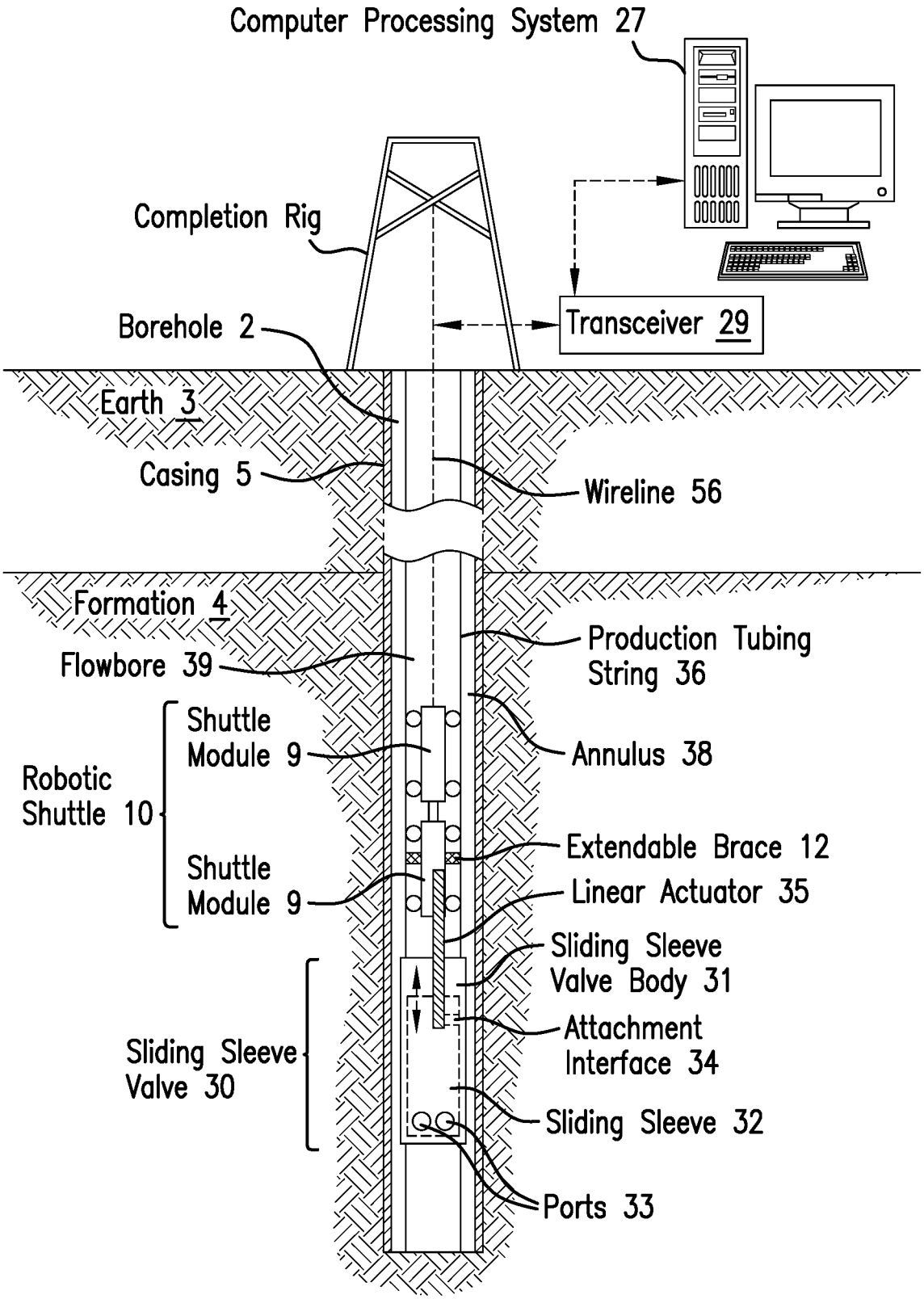
FIG. 3 depicts aspects of operating a sliding sleeve valve using the robotic shuttle.

FIG. 3 depicts aspects of operating a. sliding sleeve valve using the robotic shuttle 10. FIG. 3 illustrates the borehole 2 that has been drilled through the earth 3 and which has been lined with the casing 5. A production tubing string 36 is shown disposed within the borehole 2. An annulus 38 is defined radially between the production tubing string 36 and the casing 5. The production tubing string 36 may be formed of a number of production tubing sections, of a type known in the art, which are interconnected to one another in an end-to-end fashion. The sections may be interconnected using threaded connections or by connecting collars or in other ways known in the art Alternatively, the production tubing string 36 may be formed of coiled tubing, of a type known in the art. A central axial flowbore 39 is defined along the interior of the production tubing string 36.

A sliding sleeve valve 30 is incorporated into the production tubing string 36 in a manner known in the art. The sliding sleeve valve 30 is employed in one or more embodiments as a production nipple that can be selectively opened to permit production fluids within the wellbore 2 and from surrounding hydrocarbon-bearing formations to be flowed into the flowbore 39 of the production tubing string 36 and pumped to the surface of the borehole 2. If desired, the sliding sleeve valve 30 may be axially isolated from other portions of the wellbore 2 by packers (not shown) which are set within the annulus 38 of the borehole 2. The sliding sleeve valve 30 has a radially outer housing or body 31 with lateral fluid flow ports 33 disposed therethrough. The lateral ports 31 permit fluid communication between the annulus 38 and the interior of the housing or body 31 of the sleeve valve 30 so that fluid entering the valve 30 may be flowed to the surface of the borehole 2 via the flowbore 39. The sliding sleeve valve 30 also includes a sliding sleeve 32, which is slidably disposed within the housing or body 31 and, as is well known, moveable between a first, closed position, wherein the sleeve 32 blocks the ports 33 against fluid flow, and a second, open position, wherein fluid flow is permitted through the ports 33. Alternatively in one or more embodiments, the sliding sleeve 32 may be positioned in an intermediate position between full open and full closed to operate the valve 30 in a "choke" mode to control or modulate the flow of fluid from the annulus 38 into the flowbore 39.

The robotic shuttle 10 can be configured to operate the sliding sleeve valve 30 by sliding the sliding sleeve 32 into a selected position. One robotic module 9 can be configured to slide the sleeve 32 using a linear actuator 35. In one or more non-limiting embodiments, the linear actuator 35 may be operated hydraulically such as by a hydraulic piston (not shown) or electrically using an electric motor (not shown) to operate a screw-type linear actuator. The linear actuator 35 may be configured to interlock with or grasp an attachment interface 34 in order to slide the sleeve 32 into the selected position. In general, the robotic shuttle 9 having the linear actuator 35 may be locked in place using the extendable brace 12 in order to slide the sleeve 32. In one or more embodiments, the attachment interface 34 is a protrusion such as an eyelet disposed internal to the sleeve 32 such that the attachment interface 34 is accessible to the linear actuator 35. In one or more embodiments, the linear actuator 35 includes the grabber 26 to grasp or interlock with the attachment interface 34. The robotic shuttle 10 may provide imaging and lighting capability to identify an operable position of the sliding sleeve 32 and to aid in the linear actuator 35 grasping or interlocking with the attachment interface 34.

In an alternative embodiment, the linear actuator 35 may be attached to a downhole tool, represented in FIG. 3 by the robotic shuttle module 9 to Which the actuator 35 is attached. The downhole tool may be conveyed by a wireline 56 that may provide power from the surface of the earth and/or communication capability with an operator at the surface of the earth. The downhole tool may also include the extendable brace 12 to lock the downhole tool in place and imaging and lighting capability such that the operator at the surface can view operation of the linear actuator 35 and, thus, remotely control the linear actuator 35 via commands transmitted over the wireline 56.

Figure 4:
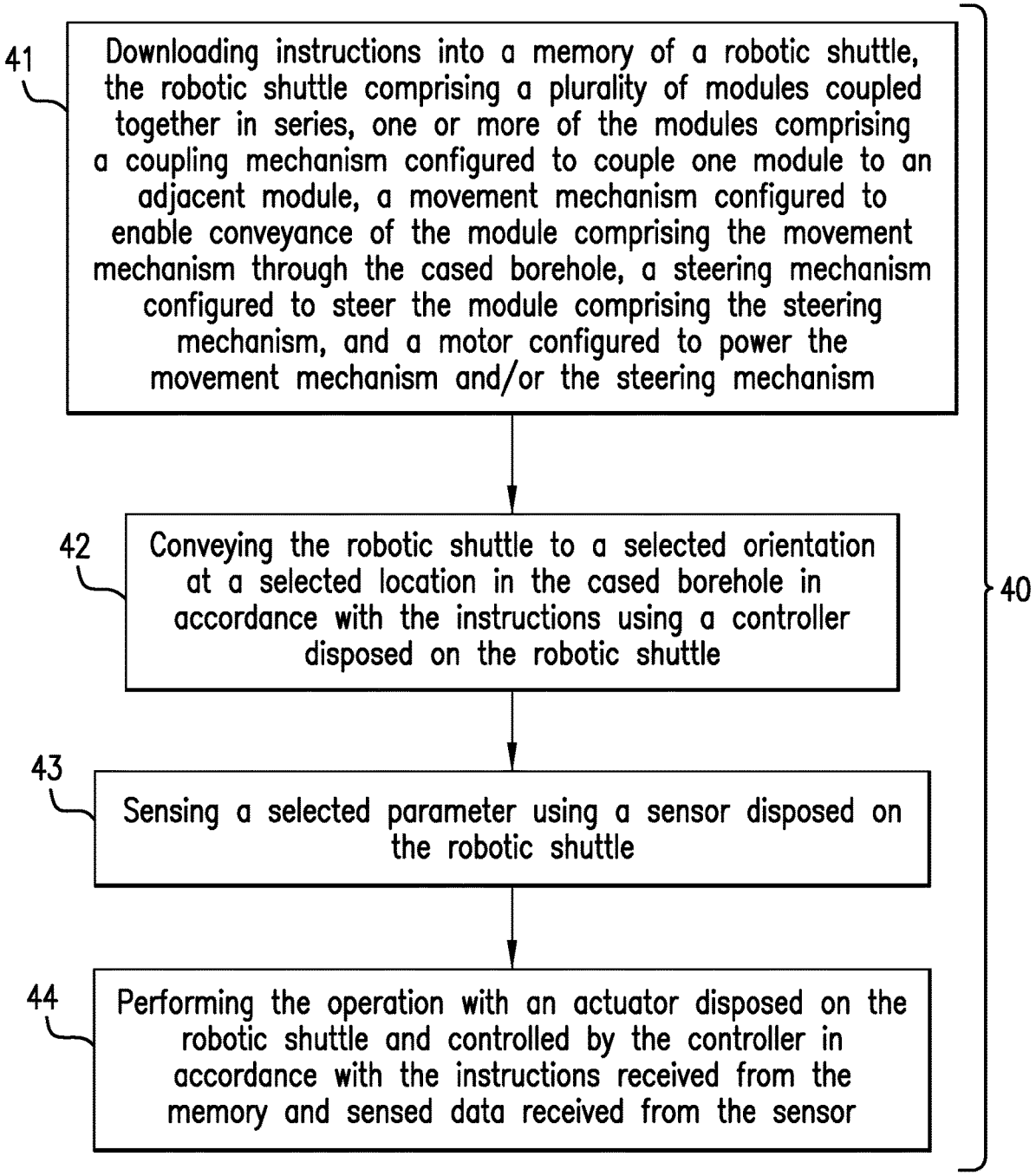
FIG. 4 is a flow chart for a method for performing an operation in a borehole penetrating the earth.

FIG. 4 is a flow chart for a method 40 for performing an operation in a cased borehole penetrating the earth. Block 41 calls for downloading instructions into a memory of a robotic shuttle, the robotic shuttle comprising a plurality of modules coupled together in series, one or more of the modules comprising a coupling mechanism configured to couple one module to an adjacent module, a movement mechanism configured to enable conveyance of the module comprising the movement mechanism through the cased borehole, a steering mechanism configured to steer the movement mechanism, and a motor configured to power the movement mechanism.

Block 42 calls for conveying the robotic shuttle to a selected orientation at a selected location in the cased borehole in accordance with the instructions using a controller disposed on the robotic shuttle.

Block 43 calls for sensing a selected parameter using a sensor disposed on the robotic shuttle.

Block 44 calls for performing the operation with a robotic arm disposed on the robotic shuffle and controlled by the controller in accordance with the instructions received from the memory and sensed data from the sensor.

The method 40 may also include identifying the location using the sensor to sense or detect a marker on the cased borehole.

The method 40 may also include extending a brace of one or more of the shuttle modules to engage a wall of the cased borehole to anchor the one or more of the shuttle modules in place. Anchoring a shuttle module in place can allow that shuttle module to perform an operation without that shuffle module moving in reaction to that operation.

The method 40 may also include attaching a tool to the robotic arm and using the tool to perform the operation.

The method 40 may also include transporting a payload to a selected location in the borehole using one or more of the shuttle modules. For example, the payload may be carried by one shuttle module and offloaded by the robotic arm.

The robotic shuttle 10 has many advantages. One advantage is that the robotic shuttle can be programed to perform a number of specific operations without necessarily requiring purpose-built shuttle modules thereby providing a cost advantage and time savings. Another advantage is that the robotic shuttle can perform a number of different operations during one run in the borehole. Yet another advantage is that the robotic shuttle can be reprogramed downhole as the need arises.

The robotic shuttle or downhole tool with the linear actuator 35 provides several advantages. One advantage is that well operators can now adjust sliding sleeve valves at a cost that is much lower than the cost of a complete intelligent completion system. Another advantage is that imaging and lighting systems disposed on the robotic shuttle or downhole tool can be used to troubleshoot a sliding sleeve valve that does not appear to be operating satisfactorily.

Embodiment 1: A downhole robotic shuttle including a plurality of modules configured to be coupled together in series wherein the series of modules is configured to be conveyed through a cased borehole penetrating a geologic formation, one or more of the modules in the plurality of modules including a coupling mechanism configured to couple one module to an adjacent module, a movement mechanism configured to enable conveyance of the module including the movement mechanism through the cased borehole, a steering mechanism configured to steer the module including the steering mechanism to achieve a selected orientation within the cased borehole, a motor configured to power the movement mechanism and/or the steering mechanism, an actuator configured to perform a selected action, a sensor configured to sense a selected parameter, a memory configured to receive instructions for performing at least one of the selected action and another action, and a controller configured to control at least one of the motor, steering mechanism, actuator, or sensor in accordance with the instructions received from the memory and sensed data received from the sensor.

Embodiment 2: The downhole robotic shuttle according to any prior embodiment, wherein one or more of the modules includes a tool configured to be operated by the actuator.

Embodiment 3: The downhole robotic shuttle according to any prior embodiment, wherein the tool includes at least one of a welding device and a cutting device.

Embodiment 4: The downhole robotic shuttle according to any prior embodiment, wherein the actuator includes a robotic arm and the robotic arm is configured to operate in at least one of a rotary motion or a linear motion.

Embodiment 5: The downhole robotic shuttle according to any prior embodiment, wherein one or more modules are configured to carry a payload and the robotic arm is configured to offload the payload.

Embodiment 6: The downhole robotic shuttle according to any prior embodiment, wherein the sensor is configured to sense at least one of an image, light intensity, electromagnetic energy, acoustic energy, chemical substance, and radiation.

Embodiment 7: The downhole robotic shuttle according to any prior embodiment, wherein the sensor is configured to sense an identification marker on the cased borehole.

Embodiment 8: The downhole robotic shuttle according to any prior embodiment, wherein one or more of the modules includes a light source configured to illuminate an interior of the cased borehole.

Embodiment 9: The downhole robotic shuttle according to any prior embodiment, wherein one or more of the modules includes an extendable brace configured to extend to engage a wall of the cased borehole to anchor the one or more of the modules including the extendable brace.

Embodiment 10: The downhole robotic shuttle according to any prior embodiment, wherein the actuator is configured to operate a sliding sleeve in a sliding sleeve valve disposed within the cased borehole.

Embodiment 11: The downhole robotic shuttle according to any prior embodiment, wherein the robotic shuttle is coupled to a wireline at one end of the wireline and a surface transceiver at the other end of the wireline.

Embodiment 12: The downhole robotic shuttle according to any prior embodiment, wherein the coupling mechanism includes at least one of a power bus or a communication bus.

Embodiment 13: A method for performing an operation in a cased geologic borehole penetrating a geologic formation, the method including downloading instructions into a memory of a robotic shuttle, the robotic shuttle including a plurality of modules coupled together in series, one or more of the modules including a coupling mechanism configured to couple one module to an adjacent module, a movement mechanism configured to enable conveyance of the module including the movement mechanism through the cased borehole, a steering mechanism configured to steer the module including the steering mechanism, and a motor configured to power the movement mechanism and/or the steering mechanism, conveying the robotic shuttle to a selected orientation at a selected location in the cased borehole in accordance with the instructions using a controller disposed on the robotic shuttle, sensing a selected parameter using a sensor disposed on the robotic shuffle, and performing the operation with an actuator disposed on the robotic shuttle and controlled by the controller in accordance with the instructions received from the memory and sensed data received from the sensor.

Embodiment 14: The method according to any prior embodiment further including identifying the location using the sensor to detect a marker disposed on the cased borehole.

Embodiment 15: The method according to any prior embodiment, further including extending a brace on one or more of the shuttle modules to engage a wall of the cased borehole to anchor the one or more of the shuttle modules in place.

Embodiment 16: The method according to any prior embodiment, wherein the actuator includes a robotic arm.

Embodiment 17: The method according to any prior embodiment, further including attaching a tool to the robotic arm and using the tool to perform the operation.

Embodiment 18: The method according to any prior embodiment further including transporting a payload to a selected location in the borehole using one or more of the shuttle modules.

Embodiment 19: The method according to any prior embodiment, further including sliding a sliding sleeve in a sliding sleeve valve disposed in the cased borehole to a selected position using the actuator.

Embodiment 20: The method according to any prior embodiment, wherein sliding includes engaging an attachment interface on the sliding sleeve.

In support of the teachings herein, various analysis components may be used, including a digital and/or an analog system. For example, the sensor 13, controller 17, telemetry 28, transceiver 29, computer processing system 19, and/or surface computer processing system 27 may include digital and/or analog systems. The system may have components such as a processor, storage media, memory, input, output, communications link (wired, wireless, optical or other), user interfaces (e.g., a display or printer), software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer-readable medium, including memory (ROMs, RAMs), optical (CD-ROMs), or magnetic (disks, hard drives), or any other type that when executed causes a computer to implement the method of the present invention. These instructions may provide for equipment operation, control, data. collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured.

The flow diagram depicted herein is just an example. There may be many variations to this diagram or the steps (or operations) described therein without departing from the spirit of the invention. For instance, the steps may be performed in a differing order, or steps may be added, deleted or modified. All of these variations are considered a part of the claimed invention.

The disclosure illustratively disclosed herein may be practiced in the absence of any element which is not specifically disclosed herein.

While one or more embodiments have been shown and described, modifications and substitutions may be made thereto without departing from the scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made, and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A downhole robotic shuttle comprising:

a plurality of modules configured to be coupled together in series wherein the series of modules is configured to be conveyed through a cased borehole penetrating a geologic formation;

one or more of the modules in the plurality of modules comprising:

a coupling mechanism configured to couple one module to an adjacent module, each module in the plurality comprising a first coupling mechanism at one end of the module and a second coupling mechanism at an opposing end of the module for coupling to the adjacent module;

a movement mechanism configured to enable conveyance of the module comprising the movement mechanism through the cased borehole;

a steering mechanism coupled to the movement mechanism and configured to steer the movement mechanism to achieve a selected orientation within the cased borehole;

a motor configured to power the movement mechanism and/or the steering mechanism;

an actuator configured to perform a selected action;

a sensor configured to sense a selected parameter to provide sensed data;

a memory configured to receive instructions for performing at least one of the selected action and another action;

map information stored in the memory;

a controller configured to control at least one of the motor, steering mechanism, actuator, or sensor in accordance with the instructions received from the memory and sensed data received from the sensor, the controller further configured to navigate the downhole robotic shuttle to a selected location based on the map information and the sensed data by controlling the steering mechanism.

2. The downhole robotic shuttle according to claim 1, wherein one or more of the modules comprises a tool configured to be operated by the actuator.

3. The downhole robotic shuttle according to claim 2, wherein the tool comprises at least one of a welding device and a cutting device.

4. The downhole robotic shuttle according to claim 1, wherein the actuator comprises a robotic arm and the robotic arm is configured to operate in at least one of a rotary motion or a linear motion.

5. The downhole robotic shuttle according to claim 4, wherein one or more modules are configured to carry a payload and the robotic arm is configured to offload the payload.

6. The downhole robotic shuttle according to claim 1, wherein the sensor is configured to sense at least one of an image, light intensity, electromagnetic energy, acoustic energy, chemical substance, or radiation.

7. The downhole robotic shuttle according to claim 6, wherein the sensor is configured to sense an identification marker on the cased borehole.

8. The downhole robotic shuttle according to claim 1, wherein one or more of the modules comprises a light source configured to illuminate an interior of the cased borehole.

9. The downhole robotic shuttle according to claim 1, wherein one or more of the modules comprises an extendable brace configured to extend to engage a wall of the cased borehole to anchor the one or more of the modules comprising the extendable brace.

10. The downhole robotic shuttle according to claim 1, wherein the actuator is configured to operate a sliding sleeve in a sliding sleeve valve disposed within the cased borehole.

11. The downhole robotic shuttle according to claim 10, wherein the robotic shuttle is coupled to a wireline at one end of the wireline and a surface transceiver at the other end of the wireline.

12. The downhole robotic shuttle according to claim 1, wherein the coupling mechanism comprises at least one of a power bus or a communication bus.

13. A method for performing an operation in a cased geologic borehole penetrating a geologic formation, the method comprising.

downloading instructions into a memory of a robotic shuttle, the robotic shuttle comprising a plurality of modules coupled together in series, one or more of the modules comprising a coupling mechanism configured to couple one module to an adjacent module, each module in the plurality comprising a first coupling mechanism at one end of the module and a second coupling mechanism at an opposing end of the module for coupling to the adjacent module, a movement mechanism configured to enable conveyance of the module comprising the movement mechanism through the cased borehole, a steering mechanism coupled to the movement mechanism and configured to steer the movement mechanism, and a motor configured to power the movement mechanism and/or the steering mechanism;

storing map information in the memory;

conveying the robotic shuttle to a selected orientation at a selected location in the cased borehole in accordance with the instructions using a controller disposed on the robotic shuttle, the controller configured to navigate the robotic shuttle to the selected location based on the map information and sensed data by controlling the steering mechanism;

sensing a selected parameter using a sensor disposed on the robotic shuttle; and performing the operation with an actuator disposed on the robotic shuttle and controlled by the controller in accordance with the instructions received from the memory and sensed data received from the sensor.

14. The method according to claim 13, further comprising identifying the location using the sensor to detect a marker disposed on the cased borehole.

15. The method according to claim 13, further comprising extending a brace on one or more of the shuttle modules to engage a wall of the cased borehole to anchor the one or more of the shuttle modules in place.

16. The method according to claim 13, wherein the actuator comprises a robotic arm.

17. The method according to claim 13, further comprising attaching a tool to the robotic arm and using the tool to perform the operation.

18. The method according to claim 13, further comprising transporting a payload to a selected location in the borehole using one or more of the shuttle modules.

19. The method according to claim 13, further comprising sliding a sliding sleeve in a sliding sleeve valve disposed in the cased borehole to a selected position using the actuator.

20. The method according to claim 19, wherein sliding comprises engaging an attachment interface on the sliding sleeve.

* * * * *